US005494600A

United States Patent [19]

Surutzidis et al.

[11] Patent Number: 5,494,600

[45] Date of Patent: Feb. 27, 1996

[54] DETERGENT ADDITIVE ABSORBED INTO A POROUS HYDROPHOBIC MATERIAL HAVING A HYDROPHOBIC COATING

[75] Inventors: Athanasios Surutzidis, Wemmel; Roger J. Jones, Jauche, both of Belgium

[73] Assignee: The Procter & Gamble Company, Cincinnati, Ohio

[21] Appl. No.: 381,893

[22] PCT Filed: Jul. 28, 1993

[86] PCT No.: PCT/US93/07088

§ 371 Date: Feb. 8, 1995

§ 102(e) Date: Feb. 8, 1995

[87] PCT Pub. No.: WO94/04267

PCT Pub. Date: Mar. 3, 1994

[30] Foreign Application Priority Data

Aug. 18, 1992 [EP] European Pat. Off. ..... 92202534

[51] Int. Cl.[6] ..... C11D 3/14; C11D 3/386; C11D 3/395; C11D 11/00

[52] U.S. Cl. ..... 252/91; 252/89.1; 252/95; 252/102; 252/118; 252/121; 252/173; 252/174; 252/174.12; 252/174.13; 252/174.15; 252/174.18; 252/174.21; 252/174.23; 252/174.25; 252/186.25; 252/542; 252/DIG. 12; 252/DIG. 14; 435/187; 435/188; 502/407

[58] Field of Search ..... 252/90, 91, 102, 252/118, 121, 173, 174, 174.12, 174.17, 174.15, 174.21, 174.23, 174.25, 89.1, 186.25, 358; 435/187, 188; 502/407

[56] References Cited

U.S. PATENT DOCUMENTS

| | | | |
|---|---|---|---|
| 2,935,481 | 5/1960 | Hochwait | 252/301.3 |
| 3,933,672 | 1/1976 | Bartolotta et al. | 252/116 |
| 4,090,973 | 5/1978 | Maguire, Jr. et al. | 252/89 R |
| 4,243,545 | 1/1981 | Campbell et al. | 252/140 |
| 4,399,049 | 8/1983 | Gray et al. | 252/91 |
| 4,447,349 | 5/1984 | Tai | 252/174.13 |
| 4,451,387 | 5/1984 | Tai | 252/174.15 |
| 4,824,593 | 4/1989 | Appel | 252/127 |
| 4,906,396 | 3/1990 | Falholt et al. | 252/174.12 |
| 5,186,118 | 2/1993 | Stinson | 116/214 |
| 5,318,903 | 6/1994 | Bewert | 435/187 |
| 5,336,665 | 8/1994 | Garner-Gray | 252/174.13 |

*Primary Examiner*—Dennis Albrecht
*Attorney, Agent, or Firm*—Ken K. Patel; Jacobus C. Rasser; Jerry J. Yetter

[57] ABSTRACT

The present invention provides a detergent additive comprising a water-soluble or water-dispersible detergent active compound such as enzyme characterized in that said compound is mixed with a surfactant before absorption into a porous hydrophobic material such as silica, said porous material subsequently being coated with a hydrophobic material such as silicone oil. Detergent compositions containing said additive are also encompassed.

10 Claims, No Drawings

DETERGENT ADDITIVE ABSORBED INTO A POROUS HYDROPHOBIC MATERIAL HAVING A HYDROPHOBIC COATING

FIELD OF THE INVENTION

The present invention relates to detergent active compounds and use thereof in liquid detergent compositions. More particularly, it relates to detergent active compounds having improved storage stability within a full detergent composition.

BACKGROUND OF THE INVENTION

There are many detergent active materials which require protection from atmospheric moisture, air and co-ingredients of compositions with which they are formulated.

Some of these actives include enzymes, bleaches, colourants, catalysts and other detergent active compounds.

For instance, it is well known in the art that enzyme deactivation occurs in aqueous detergent compositions containing proteolytic enzymes or mixtures of enzymes one of which is proteolytic.

The loss of detergent activity of said detergent active compounds, also referred to as detergent instability has already been retarded by chemical stabilization methods.

Yet the effectiveness of these methods tend to be limited in that different chemicals at different levels are needed to protect different detergent active compounds.

Therefore, it is an object of the present invention to provide a stabilization system that can be used to protect any detergent active compound in any detergent formulation.

According to the present invention, a detergent additive is provided comprising a hydrophillic detergent active compound characterized in that said compound is mixed with a surfactant before absorption into a porous hydrophobic material, said porous material subsequently being coated with a hydrophobic material.

According to one embodiment, the present invention provides detergent compositions comprising detergent active compounds which have improved stability upon storage.

According to another embodiment, the porous hydrophobic material comprising a detergent active compound being absorbed into said hydrophobic material can be used to store said detergent active compounds in the form of non-dusting granulates.

SUMMARY OF THE INVENTION

The present invention provides a detergent additive comprising a water-soluble or water-dispersible detergent active compound characterized in that a mixture of said compound with a surfactant is absorbed into a porous hydrophobic material, said porous material being coated with a hydrophobic material.

DETAILED DESCRIPTION OF THE INVENTION

The present invention relates to a stabilization system for detergent active compounds having improved storage stability within a full detergent composition.

As utilized herein "stabilization" refers to protecting the detergent active compounds by isolating and protecting them from their hostile environment upon storage but releasing said compounds during washing conditions.

According to the present invention the detergent active compounds are isolated from their hostile environment by reversibly absorbing said compounds into a porous hydrophobic material.

In this way, the porous hydrophobic material serves as a "cage" wherein the detergent active compound is enclosed. Subsequently, the pores of the detergent additive filled hydrophobic porous material are sealed by dispersing said porous material into a hydrophobic liquid.

By sealing the pores of the hydrophobic material, the hydrophobic liquid acts as a "shell", thereby protecting the detergent additive from its environment.

It has now been found that by using the "shell and cage" system of the present invention the loss of activity of the detergent active compounds is substantially reduced.

Moreover, it has been found that the protected detergent active compound according to the present invention can be readily released under washing conditions without losing the ability to perform its normal function.

More in particular, the present invention provides a detergent additive comprising a hydrophillic detergent active compound characterized in that said compound is mixed with a surfactant before absorption into a porous hydrophobic material, said porous material subsequently being coated with a hydrophobic material.

The present invention also provides a process whereby a detergent active compound is reversibly absorbed into particles of a porous hydrophobic material, said particles subsequently being dispersed into a hydrophobic liquid.

The detergent active solution

The detergent active solution comprises a detergent active compound and a surfactant.

Detergent active

It is widely recognized that the function of a detergent active compound can be significantly impaired in detergent compositions by interaction between the active compound and other coingredients of the detergent composition. For example, detergency enzymes can be affected by interaction with other enzymes, bleaches, acids and bases. Perfumes and bleaches can be effected by bleach activators. Cationic fabric conditioners can be effected by interaction with anionic surfactants; organic bleaches can be effected by moisture, metal contamination; brighteners/fluorescers can be affected with bleaches.

The detergent active compounds suitable for the present invention include enzymes, bleaches, bleach activators, bleach catalysts, perfumes, photoactivators, dyes, brighteners/fluorescers, through the wash sanitizers, fabric softening or conditioning agents, hydrolysable surfactants, and other detergent active compounds which are water-soluble or water-dispersible and mixtures thereof.

A preferred class of a detergent active compound is a detergency enzyme. Examples of enzymes suitable for the present invention are enzymes which are active in the removal of soils or stains such as protease, lipase, amylase, carboxylase, cellulase, oxidase, peroxidase or mixtures thereof.

The enzyme may be present in the form of an enzyme solution, e.g. in water or a lower water miscible, mono-, di- or polyhydric alcohol such as propylene glycol and optionally containing enzyme stabilizers such as is known in the art. Enzyme stabilizers which may be present include lower alcohols, e.g. glycerol, lower mono- or di- carboxylic acid and their salts, especially formates and oxidates, borates and calcium salts.

Suitable detergent active compounds can also be represented by bleaches, bleach activator and bleach catalysts. Suitable inorganic bleaches include perborates, percarbonates. Suitable organic bleaches include peroxyacids known in art. Suitable bleach precursors are peracetic acid bleach precursors such as tetraacetylethylenediamine, triacetin, and acethyl trimethyl citrate.

Other detergent active compounds suitable for the present invention are fabric softening or conditioning agents, fluorescers, dyes, photoactivators through the wash sanitizers such as phenoxyethanol, and other detergent active compounds which are water-soluble or water-dispersible and which tend to be unstable upon storage, and mixtures thereof.

Surfactant

An essential feature of the present invention is that the detergent active compound is mixed with a surfactant before being absorbed into the porous material.

Due to the hydrophillic nature of the detergent active suitable for the present invention, the detergent active does not spontaneously wet the surfaces of the hydrophobic material. It has been found that by adding surfactant the detergent active solution is readily absorbed into the pores of the hydrophobic material.

Furthermore, it has been surprisingly found that by adding said surfactant to the detergent active the detergent active solution is not immobilized onto the hydrophobic material and can be readily desorbed during washing conditions.

The surfactant suitable for the present invention should be compatible with the detergent active compound.

The surfactant to be used for instance, in the case the detergent active is an enzyme a surfactant used is preferably a nonionic surfactant. A wide range of nonionic surfactants can be used.

One class of nonionic surfactants useful in the present invention are condensates of ethylene oxide with a hydrophobic moiety to provide a surfactant having an average hydrophilic-lipophilic balance (HLB) in the range from 8 to 17, preferably from 9.5 to 13.5, more preferably from 10 to 12.5. The hydrophobic (lipophilic) moiety may be aliphatic or aromatic in nature and the length of the polyoxyethylene group which is condensed with any particular hydrophobic group can be readily adjusted to yield a water-soluble compound having the desired degree of balance between hydrophilic and hydrophobic elements.

Especially preferred nonionic surfactants of this type are the $C_9$–$C_{15}$ primary alcohol ethoxylates containing 3–8 moles of ethylene oxide per mole of alcohol, particularly the $C_{14}$–$C_{15}$ primary alcohols containing 6–8 moles of ethylene oxide per mole of alcohol and the $C_{12}$–$C_{14}$ primary alcohols containing 3–5 moles of ethylene oxide per mole of alcohol.

Anionic or cationic surfactants are less likely to be used. However, if the absorbed detergent active is unaffected by these surfactants they can alternatively be used.

The level of surfactant used in the present invention should be such to ensure sufficient wetting of the hydrophobic material. At high levels of surfactant, agglomerates can be formed. Therefore, the level of surfactant that can be used should be such to maintain a free flowing hydrophobic powder.

The active-filled porous hydrophobic material may contain additional ingredients, which can be premixed with the surfactant before they are absorbed into the porous hydrophobic material. These materials include other active compounds such as perfumes, brighteners, bleaches, softeners and other conventional optional ingredients such as buffers, electrolytes, etc. as far as they are chemically compatible with the surfactant active solution.

Porous hydrophobic material

The surfactant containing detergent active solution is absorbed into the pores of the hydrophobic material.

The porous hydrophobic material suitable for the present invention can be any hydrophobic porous material having an average pore diameter larger than the size of the molecules that are to be absorbed in the porous material. Pore volumes and pore size distributions may be measured by the recognized technique of mercury intrusion porosimetry.

For instance, if the detergent active compound is an enzyme, an average pore diameter of the hydrophobic material of 500 angstroms or higher is preferred.

The preferred hydrophobic material that then can be used is silica. The average pore diameter of the currently used silica is 1000 Å while the absorbed enzyme molecules have diameters in the range of 50 to 150 Å.

The silica particles can be rendered hyrophobic by treating them with dialkylsilane groups and/or trialkylsilane groups either bonded directly onto the silica or by means of silicone resin. The silica is further characterized by a high absorption value. The absorption can be expressed as Dibutylphthalate (DBP) number. Porous silica suitable for the present invention is available under the trade name Sipernat® from Degussa.

Hydrophobic coating material

The hydrophobic coating material provides a protective coating for the active-filled porous hydrophobic materials herein.

Coating the pores of the hydrophobic material isolates the detergent active compound from environments which causes the degradation of the active compounds.

The active compounds remain in their stabilized material environment without interacting with other potentially harmful detergent ingredients or the environment is protected from the detergent active compound itself.

The level of hydrophobic coating material should be such that appropriate coverage of all additive-filled porous hydrophobic material is secured.

The hydrophobic coating material herein is preferably a hydrophobic liquid polymer.

Such a polymer may be an organo polysiloxane oil, e.g. a polydi(alkyl) siloxane, especially a polydi(methyl) siloxane. Especially preferred are hydrophobic silicone oils which have been proposed for use as antifoam in liquid detergents.

If the detergent active compound is an enzyme, the silicone oil to enzyme-filled silica ratio should be at least 1.5:1.

Alternatively the hydrophobic coating material may be a high molecular weight hydrocarbon like petroleum jelly, wax, or water insoluble but water permeable polymeric material such as carboxymethylcellulose, polyvinyl alcohol, polyvinyl pyrrolidone or polycaprolactone.

Detergent ingredients

In another embodiment of the present invention, detergent compositions are provided, comprising the detergent active composition of the present invention, and further comprising detergent ingredients. Detergent compositions within the meaning herein, include laundry detergent compositions, dishwashing compositions or hard surface cleaning compositions. Detergent ingredients include surfactants, builders and optional detergent additives. A wide range of surfactants can be used in the detergent composition of the present invention.

A typical listing of anionic, nonionic, ampholytic and zwitterionic classes, and species of these surfactants, is given in U.S. Pat. No. 3,664,961 issued to Norris on May 23, 1972.

Mixtures of anionic surfactants are particularly suitable herein, especially mixtures of sulphonate and sulphate surfactants in a weight ratio of from 5:1 to 1:2, preferably from 3:1 to 2:3, more preferably from 3:1 to 1:1. Preferred sulphonates include alkyl benzene sulphonates having from 9 to 15, especially 11 to 13 carbon atoms in the alkyl radical, and alpha-sulphonated methyl fatty acid esters in which the fatty acid is derived from a $C_{12}$–$C_{18}$ fatty source preferably from a $C_{16}$–$C_{18}$ fatty source. In each instance the cation is an alkali metal, preferably sodium. Preferred sulphate surfactants are alkyl sulphates having from 12 to 18 carbon atoms in the alkyl radical, optionally in admixture with ethoxy sulphates having from 10 to 20, preferably 10 to 16 carbon atoms in the alkyl radical and an average degree of ethoxylation of 1 to 6. Examples of preferred alkyl sulphates herein are tallow alkyl sulphate, coconut alkyl sulphate, and $C_{14-15}$ alkyl sulphates. The cation in each instance is again an alkali metal cation, preferably sodium.

One class of nonionic surfactants useful in the present invention are condensates of ethylene oxide with a hydrophobic moiety to provide a surfactant having an average hydrophilic-lipophilic from 9.5 to 13.5, more preferably from 10 to 12.5. The hydrophobic (lipophilic) moiety may be aliphatic or aromatic in nature and the length of the polyoxyethylene group which is condensed with any particular hydrophobic group can be readily adjusted to yield a water-soluble compound having the desired degree of balance between hydrophilic and hydrophobic elements.

Especially preferred nonionic surfactants of this type are the $C_9$–$C_{15}$ primary alcohol ethoxylates containing 3–8 moles of ethylene oxide per mole of alcohol, particularly the $C_{14}$–$C_{15}$ primary alcohols containing 6–8 moles of ethylene oxide per mole of alcohol and the $C_{12}$–$C_{14}$ primary alcohols containing 3–5 moles of ethylene oxide per mole of alcohol.

Another class of nonionic surfactants comprises alkyl polyglucoside compounds of general formula $$RO\,(C_nH_{2n}O)\,t^Zx$$

wherein Z is a moiety derived from glucose; R is a saturated hydrophobic alkyl group that contains from 12 to 18 carbon atoms; t is from 0 to 10 and n is 2 or 3; x is from 1.3 to 4, the compounds including less than 10% unreacted fatty alcohol and less than 50% short chain alkyl polyglucosides. Compounds of this type and their use in detergent are disclosed in EP-B 0 070 077, 0 075 996 and 0 094 118.

Also suitable as nonionic surfactants are poly hydroxy fatty acid amide surfactants of the formula $$R^2-\underset{\underset{O}{|}}{C}-\underset{\underset{R^1}{|}}{N}-Z,$$

wherein $R^1$ is H, or $R^1$ is $C_{1-4}$ hydrocarbyl, 2-hydroxy ethyl, 2-hydroxy propyl or a mixture thereof, $R^2$ is $C_{5-31}$ hydrocarbyl and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is a straight $C_{11-15}$ alkyl or alkenyl chain such as coconut alkyl or mixtures thereof, and Z is derived from a reducing sugar such as glucose, fructose, maltose, lactose, in a reductive amination reaction.

The compositions according to the present invention may further comprise a builder system. Any conventional builder system is suitable for use herein including aluminosilicate materials, silicates, polycarboxylates and fatty acids, materials such as ethylenediamine tetraacetate, metal ion sequestrants such as aminopolyphosphonates, particularly ethylenediamine tetramethylene phosphonic acid and diethylene triamine pentamethylenephosphonic acid. Though less preferred for obvious environmental reasons, phosphate builders can also be used herein.

Suitable builders can be an inorganic ion exchange material, commonly an inorganic hydrated aluminosilicate material, more particularly a hydrated synthetic zeolite such as hydrated zeolite A, X, B or HS.

Another suitable inorganic builder material is layered silicate, e.g. SKS-6 (Hoechst). SKS-6 is a crystalline layered silicate consisting of sodium silicate ($Na_2Si_2O_5$).

Suitable polycarboxylates builders for use herein include citric acid, preferably in the form of a water-soluble salt, derivatives of succinic acid of the formula R—CH(COOH)CH2(COOH) wherein R is C10–20 alkyl or alkenyl, preferably C12–16, or wherein R can be substituted with hydroxyl, sulfo sulfoxyl or sulfone substituents. Specific examples include lauryl succinate , myristyl succinate, palmityl succinate2-dodecenylsuccinate, 2-tetradecenyl succinate. Succinate builders are preferably used in the form of their water-soluble salts, including sodium, potassium, ammonium and alkanolammonium salts.

Other suitable polycarboxylates are oxodisuccinates and mixtures of tartrate monosuccinic and tartrate disuccinic acid such as described in U.S. Pat. No. 4,663,071.

Especially suitable fatty acid builders for use herein are saturated or unsaturated C10–18 fatty acids, as well as the corresponding soaps. Preferred saturated species have from 12 to 16 carbon atoms in the alkyl chain. The preferred unsaturated fatty acid is oleic acid. Another preferred builder system for liquid compositions is based on dodecenyl succinic acid.

Other suitable water-soluble organic salts are the homo- or copolymeric acids or their salts, in which the polycarboxylic acid comprises at least two carboxyl radicals separated from each other by not more than two carbon atoms.

Polymers of this type are disclosed in GB-A-1,596,756. Examples of such salts are polyacrylates of MW 2000–5000 and their copolymers with maleic anhydride, such copolymers having a molecular weight of from 20,000 to 70,000, especially about 40,000.

In laundry detergent compositions detergency builder salts are normally included in amounts of from 10% to 80% by weight of the composition preferably from 20% to 70% and most usually from 30% to 60% by weight.

Other components used in detergent compositions may be employed, such enzymes and stabilizers or activators therefore, soil-suspending agents, soil-release agents, optical brighteners, abrasives, bactericides, tarnish inhibitors, coloring agents, and perfumes.

The laundry detergent compositions according to the present invention can be in the liquid form and in particular in "compact form"; in such case, the liquid detergent compositions according to the present invention will contain a lower amount of water, compared to conventional liquid detergents. The detergent additive in liquid form according to the present invention will typically be emulsified in said liquid detergent composition.

The laundry detergent compositions according to the present invention can be in granular form and incorporate a builder salt. Granular compositions according to the present invention can also be in in "compact form"; i.e. they may have a relatively higher density than conventional granular detergent compositions according to the present invention will contain a lower amount of "inorganic filler salt", compared to conventional granular detergents; typical filler salts are alkaline earth metal salts of sulphates and chlorides, typically sodium sulphate; "compact" detergents typically comprise not more than 10% filler salt.

The detergent additives herein in liquid form will typically be sprayed onto the granules of said detergent compositions.

Liquid dishwashing compositions according to the present invention typically contains an enzyme or a mixture of enzymes as the protected detergent active.

Liquid dishwashing compositions, and hard surface cleaning compositions are described in, resp., International Applications WO 92/06171 and EP-A- 428 816.

The following examples illustrate the present invention and the improved stability of detergent actives obtained therefrom.

More in particular, these examples illustrate the benefits of the present invention if enzymes are used as a detergent active.

EXAMPLE I

A detergent additive according to the present invention is processed by adsorbing the enzyme solution into the pores of hydrophobic silica which is then dispersed in silicone oil. In order to provide a detergent composition comprising the detergent additive of the present invention, the silicone oil dispersion is finally dispersed in the liquid detergent matrix. The process encompasses the following steps and is exemplified with silica as a porous hydrophobic material and silica oil as a hydrophobic protective coating layer:

1. Non-ionic surfactant (alkyl alcohol ethylene oxide condensate with an average of 7 ethoxylate units and an alkyl chain length of 13 to 15 carbon atoms having a HLB-value of 9 to 13) is added at approximately 3 to 5% by weight in the raw enzyme solution.
2. The surfactant containing enzyme solution is then combined with porous hydrophobic silica (currently used Sipernat D10 ex Degussa) at ratio 2.5 times the silica's weight (corresponding to the silica's total pore volume). The enzyme solution is added in a dropwise manner under stirring (no more than 1000 rpms to aid the production of a homogeneously enzyme filled silica). At this stage the product is still in powder form. A variant of this step includes the addition of 5% of hydrophobic silica Aerosil R972 ex Degussa after the enzyme adsorption has occured.
3. This powder is subsequently dispersed in silicone oil (polydimethylsiloxane). We have currently experimented with silicone oils with viscosities of 500, 1000, 5000, 12500 and 30000 cs. Dispersion occurs under continuous stirring with a propeller mixer at 1600 to 1850 rpm for about 3 minutes.
4. The silicone oil dispersion is finally emulsified in the detergent matrix by techniques known in art.

EXAMPLE II

Selection of the hydrophobic porous material

The porous hydrophobic material suitable for the present invention has a high absorption value and an average pore diameter larger than the average enzyme molecular size.

Porous silica corresponding to the above specification available under the trade name Sipernat®from Degussa is used. Based on DBP (Dibutyl Phthalate) absorption data for Sipernat$^{200}$ D10 (2.4 g DBP absorbed/g of silica) and DBP's density (=1.0484 $cm^3/g$), the total pore volume per gram of silica is calculated.

Pore Volume (PV) =2.289 $cm^3/g$ of silica The average pore diameter is given by the empirical equation:

$$\text{Pore Diameter} = \frac{4 \times 104 \times PV\,(cm^3/g)}{S\,(m^2/g)} = 1017\ \text{Å}$$

where S is the specific surface area of Sipernat D10(=90 m2/g). Since the average enzyme molecular diameter does not exceed approximately 150 Å there is no hindrance.

EXAMPLE III

The following detergent compositions are prepared, all based on a liquid detergent composition. Such a liquid detergent composition typically contains the following ingredients:

TABLE I

| | % by weight of the total detergent composition | |
|---|---|---|
| | I | II |
| Linear alkylbenzene sulfonate | 10 | 15 |
| Alkyl sulphate | 4 | |
| Fatty alcohol ($C_{12}$–$C_{15}$) ethoxylate | 9 | 14 |
| Fatty acid | 5 | 10 |
| Oleic acid | 4 | |
| Citric acid | 5 | 9 |
| KOH | | 3 |
| NaOH | 5.4 | |
| Monoethanolamine | | 9 |
| Propanediol | 1.5 | 9 |
| Ethanol | 5 | 1 |
| Minors | up to 100 | |

The stability of protected enzymes according to the present invention is demonstrated by storage tests. The storage stability of the "caged" enzyme formulated in a detergent compositions is compared versus the stability of a "free" (not encaged) enzyme.

The extent of the enzyme release and the activity of the released enzyme was measured in the presence of other enzymes, More in particular, the stability of caged and free cellulase was determined in the presence of Savinase. The liquid detergent composition of Table I was supplemented as indicated below:

I) 0.2% Savinase (16KNPU/g) caged cellulase having a composition as indicated below:

| silica/cellulase | | | | | | |
|---|---|---|---|---|---|---|
| Silica | Cellulase solution | ratio sil./cell.. | extra addition | amount | sil. oil 200 fluid | amount |
| Sipernat D10 | +3% $NIAO_7$ | 1:2.5 | 5% Aerosil R972 | 10 g | 1000 cs | 30 g |

II) 0.2% Savinase (16KNPU/g) Free cellulase

The samples containing caged cellulase-solution were processed according to Example I.

The samples were stored at 35° C. and analyzed for residual cellulase activity at the end of 1 week of storage.

The cellulase activity was determined indirectly by Launderometer tests. The degree of depilling of the fabrics was visually observed.

Test procedure: 0.5 kg of fabric laundry load was washed in a launderometer at 40° C. The hardness of the water was 2.5 mM Calcium and the composition concentration was 0.8% in the wash liquor. For depilling evaluation swatches of worn cotton fabrics were dried in a tumble-dryer for 30 minutes prior to assessment of the depilling performance.

Comparative depilling assessment was done by expert judges using a reference, the reference being worn cotton fabrics washed in the presence of fresh added cellulase and no Savinase. Depilling was assessed after two washcycles of three hours.

First a calibration curve was graded in order to correlate the level of cellulase with the softening performance.

Then the swatches were washed with the samples containing caged cellulase and with samples containing free cellulase and the softness performance was assessed of both samples.

Then the cellulase residual activity of both samples was determined by the calibration curve. The results are shown in the following table with activity expressed as a percentage of the initial activity of that formulation. Results:

| Sample | 1 wk, 35° C. |
|---|---|
| Free cellulase | 0 |
| caged cellulase | 75 |

The samples containing caged cellulase according to the present invention are found to exhibit substantially improved retention of enzyme activity compared with samples containing free enzyme in the presence of Savinase.

What is claimed is:

1. A particulate detergent additive comprising a mixture of a surfactant and an effective amount a water-soluble or water-dispersible detergent active absorbed into the pores of a porous hydrophobic silica having an average pore diameter larger than the size of the molecules of the detergent active, said porous hydrophobic silica containing the absorbed mixture of surfactant and detergent additive being coated completely with a hydrophobic coating material or a water-insoluble water-permeable polymeric material, provided that:

(a) the detergent active is selected from enzymes, bleaches, bleach activators, bleach catalysts, photoactivators, dyes, fluorescers and fabric conditioning agents, and (b) the absorbed surfactant is present in an amount sufficient to wet the hydrophobic silica and to permit the detergent additive to be readily desorbed during washing conditions.

2. A detergent additive according to claim 1 wherein said hydrophobic coating material is silicone oil.

3. A detergent additive according to claim 1 wherein said hydrophobic coating material is petroleum jelly.

4. A detergent additive according to claim 1 wherein said hydrophobic coating material is wax.

5. A detergent additive according to claim 1 wherein said coating material is a water-insoluble water-permeable polymeric material selected from carboxymethylcellulose, polyvinyl alcohol, polyvinylpyrrolidone, and polycaprolactone.

6. A detergent additive according to claim 1 wherein said surfactant is compatible with the detergent active compound selected from an anionic, nonionic, cationic or a zwitterionic surfactant or mixtures thereof.

7. A detergent additive according to claim 1 wherein said detergent active compound is selected from one or more of a protease, a lipase, an amylase, a cellulase, an oxidase and a peroxidase or mixtures thereof.

8. A detergent additive according to claim 7 wherein said surfactant is a nonionic surfactant or a anionic surfactant or mixtures thereof.

9. A detergent composition comprising an effective amount of the said detergent additive according to claim 1.

10. A detergent composition according to claim 9 which is a laundry detergent composition in granular form, compact granular form, liquid form or compact liquid form.

* * * * *

UNITED STATES PATENT AND TRADEMARK OFFICE

CERTIFICATE OF CORRECTION

PATENT NO. : 5,494,600

DATED : February 27, 1996

INVENTOR(S) : Athanasios Surutzidis, et al.

It is certified that error appears in the above-identified patent and that said Letters Patent is hereby corrected as shown below:

In Column 10, lines 30-31, change "said coating" to --said hydrophobic coating--.

In Column 10, line 46, change "the said detergent" to --the detergent--.

Signed and Sealed this

Sixth Day of August, 1996

*Attest:*

Bruce Lehman

BRUCE LEHMAN

*Attesting Officer*

*Commissioner of Patents and Trademarks*